US009004940B2

(12) United States Patent
Hasebe

(10) Patent No.: US 9,004,940 B2
(45) Date of Patent: Apr. 14, 2015

(54) CONNECTOR

(75) Inventor: Kiyoharu Hasebe, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 261 days.

(21) Appl. No.: 13/456,641

(22) Filed: Apr. 26, 2012

(65) Prior Publication Data

US 2012/0276787 A1 Nov. 1, 2012

(30) Foreign Application Priority Data

Apr. 28, 2011 (JP) ..... 2011-101003

(51) Int. Cl.
*H01R 13/40* (2006.01)
*H01R 13/422* (2006.01)

(52) U.S. Cl.
CPC ..... *H01R 13/4223* (2013.01)

(58) Field of Classification Search
USPC ..... 439/595, 754, 852
See application file for complete search history.

(56) References Cited

U.S. PATENT DOCUMENTS

| | | | | |
|---|---|---|---|---|
| 4,969,841 | A | 11/1990 | Sueyoshi et al. | |
| 5,588,875 | A | 12/1996 | Sawada | |
| 5,628,652 | A * | 5/1997 | Ohsumi | 439/595 |
| 5,730,625 | A * | 3/1998 | Sikora | 439/595 |
| 6,764,352 | B2 * | 7/2004 | Tsuji | 439/752 |
| 7,131,869 | B2 | 11/2006 | Fukatsu | |
| 7,563,135 | B2 | 7/2009 | Takahashi et al. | |
| 8,083,543 | B2 | 12/2011 | Omori et al. | |
| 2001/0023150 | A1 * | 9/2001 | Kashiyama et al. | 439/595 |
| 2004/0102104 | A1 | 5/2004 | Kuroda et al. | |
| 2004/0209527 | A1 * | 10/2004 | Chen | 439/852 |
| 2006/0141863 | A1 * | 6/2006 | Sakamoto | 439/595 |
| 2011/0117795 | A1 | 5/2011 | Sakamoto | |

FOREIGN PATENT DOCUMENTS

| | | | |
|---|---|---|---|
| CN | 1497795 | A | 5/2004 |
| CN | 101904058 | A | 12/2010 |
| JP | 02126376 | U | 10/1990 |

(Continued)

OTHER PUBLICATIONS

Chinese Office Action dated Mar. 19, 2014 (and English translation thereof) in counterpart Chinese Application No. 201210122682.4.

(Continued)

*Primary Examiner* — James Harvey
(74) *Attorney, Agent, or Firm* — Holtz, Holtz, Goodman & Chick PC

(57) ABSTRACT

A connector includes a contact and a housing holding the contact. The contact includes a first engaged portion and a second engaged portion which are distinguished from each other. The housing has a front end and a rear end in a front-to-rear direction. The housing is formed with an accommodating portion. The accommodating portion is configured to accommodate the contact when the contact is inserted from the rear end toward the front end to be located at an accommodating position. The housing has a lance formed within the accommodating portion. The lance is provided with a first engaging portion and a second engaging portion. The first engaging portion and the second engaging portion are configured to be engaged with the first engaged portion and the second engaged portion of the contact located at the accommodating position, respectively.

11 Claims, 10 Drawing Sheets

(56) References Cited

FOREIGN PATENT DOCUMENTS

| | | | |
|---|---|---|---|
| JP | 11176506 | A | 7/1999 |
| JP | 2003022862 | A | 1/2003 |
| JP | 2003-59573 | A | 2/2003 |
| JP | 2003068385 | A | 3/2003 |
| JP | 2005135766 | A | 5/2005 |
| JP | 2009-048889 | A | 3/2009 |
| JP | 2010-27230 | A | 2/2010 |

OTHER PUBLICATIONS

Japanese Office Action dated Jan. 7, 2015, issued in counterpart Japanese Application No. 2011-101003.

* cited by examiner

CONNECTOR

CROSS REFERENCE TO RELATED APPLICATIONS

Applicants claim priority under 35 U.S.C. §119 of Japanese Patent Application No. JP2011-101003 filed Apr. 28, 2011.

BACKGROUND OF THE INVENTION

This invention relates to a connector having a housing formed with a lance which is configured to be engaged with a contact inserted in an accommodating portion of the housing.

For example, this type of connectors is disclosed in JP-A 2003-59573 or JP-A 2010-27230, contents of which are incorporated herein by reference.

The lance of the connector disclosed in JP-A 2003-59573 has a cross-section comprising a contact-side region (i.e. a region located near a contact) and an opposite-side region (i.e. a region opposite to the contact-side region). The contact-side region has a larger area than the opposite-side region so that it is possible to securely hold the contact while the contact is easily inserted (see FIG. 18).

The connector disclosed in JP-A 2010-27230 has a housing formed with a lance therewithin. The lance has a lateral wall and a vertical wall so as to have an L-shaped cross-section (see FIG. 19). According to JP-A 2010-27230, it is possible to keep the strength of the lance even when the connector has a reduced size.

However, the structures of the connector of JP-A 2003-59573 are not suitable to reduce the size of the connector. As for the connector of JP-A 2010-27230, the contact may not be easily inserted into the connector when the connector has a holding power which holds the contact securely.

SUMMARY OF THE INVENTION

It is therefore an object of the present invention to provide a connector which, even when the connector has a reduced size, is able to hold an inserted contact securely while the contact is easily inserted.

One aspect of the present invention provides a connector comprising a contact and a housing. The contact includes a first engaged portion and a second engaged portion. The first engaged portion and the second engaged portion are distinguished from each other. The housing is configured to hold the contact. The housing has a front end and a rear end in a front-to-rear direction. The housing is formed with an accommodating portion. The accommodating portion is configured to accommodate the contact when the contact is inserted from the rear end toward the front end to be located at an accommodating position. The housing has a lance formed within the accommodating portion. The lance is provided with a first engaging portion and a second engaging portion. The first engaging portion and the second engaging portion are configured to be engaged with the first engaged portion and the second engaged portion of the contact located at the accommodating position, respectively.

An appreciation of the objectives of the present invention and a more complete understanding of its structure may be had by studying the following description of the preferred embodiment and by referring to the accompanying drawings.

Figure 1:
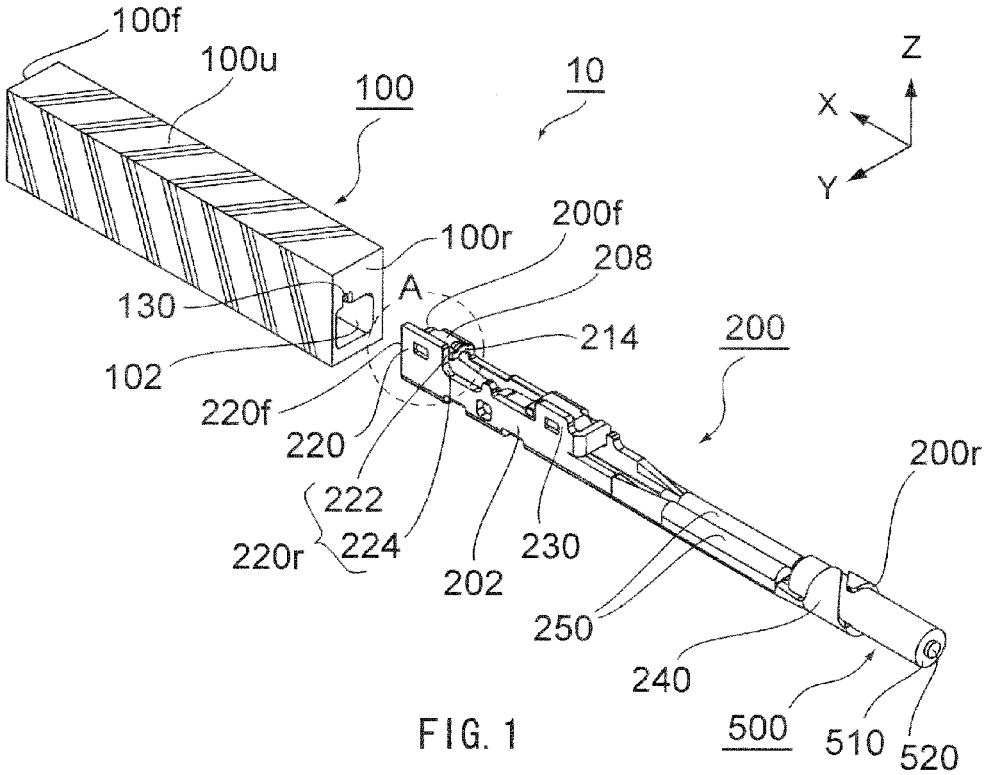
FIG. 1 is an exploded, perspective view showing a housing and a contact of a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector 10 according to an embodiment of the present invention comprises a contact 200 made of a metal and a housing 100 configured to hold the contact 200. The housing 100 is integrally molded from a resin material having elasticity. The housing 100 according to the present embodiment is a piece of a structure which is formed from a plurality of the housings 100 arranged vertically and horizontally. The housing 100 has a quadrangular prism-like shape extending long in a front-to-rear direction (X-direction) so as to have a front surface (front end) 100*f* and a rear surface (rear end) 100*r* formed on opposite ends thereof in the X-direction, respectively. The housing 100 is formed with a hole 102. The hole 102 extends from the rear end 100*r* to the front end 100*f* so as to pierce the inside of the housing 100. The hole 102 is configured so that the contact 200 is inserted thereinto along an insert direction (positive X-direction).

Figure 2:
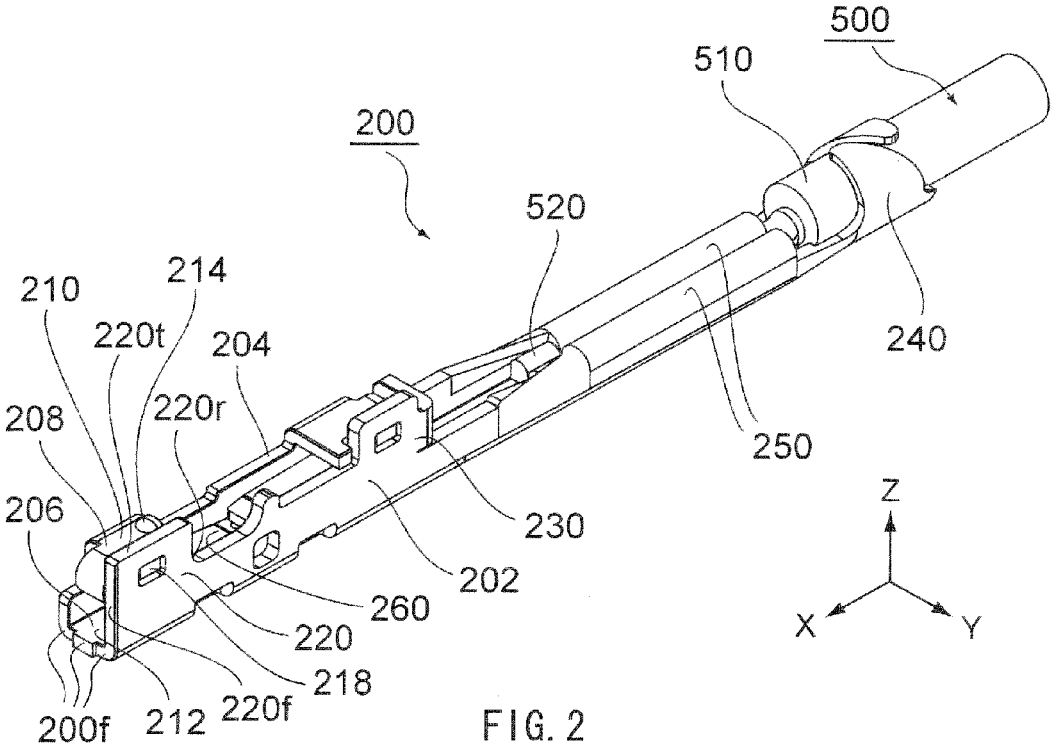
FIG. 2 is a perspective view showing the connector of FIG. 1.

As shown in FIGS. 1 and 2, the contact 200 extends long in the X-direction (front-to-rear direction) so as to have a front end 200*f* and a rear end 200*r* formed on opposite ends thereof in the X-direction. The contact 200 according to the present embodiment is a female contact which is formed by stamping and bending a common metal plate.

The contact 200 is configured so as to be able to hold a cable 500. In detail, the cable 500 comprises a core wire 520 made of a conductive material and a covering 510 made of an insulating material. The covering 510 covers the core wire 520. The contact 200 has a caulking-cover portion 240 and a caulking-wire portion 250. The caulking-cover portion 240 and the caulking-wire portion 250 are formed on a rear side (negative X-side) of the contact 200. The caulking-cover portion 240 is configured to be wound around the covering 510 to caulk it. The caulking-cover portion 240 is formed in the vicinity of the rear end 200*r* of the contact 200. The caulking-wire portion 250 is configured to caulk the core wire 520 exposed from the covering 510. The caulking-wire portion 250 is formed in front of the caulking-cover portion 240 in the X-direction (i.e. formed on the positive X-side of the contact 200 as compared with the caulking-cover portion 240). The covering 510 and the core wire 520 of the contact 200 are caulked so that an end of the cable 500 is fixed to and held by the contact 200. As a result, the contact 200 and the cable 500 are electrically connected to each other.

The contact 200 has a bottom plate 206, a first side wall 202 and a second side wall 204 each formed on a front side (positive X-side) thereof. Each of the bottom plate 206, the first side wall 202 and the second side wall 204 has a tabular shape. The bottom plate 206 extends long in the X-direction. The first side wall 202 and the second side wall 204 are connected to opposite ends of the bottom plate 206 in a width direction (Y-direction) perpendicular to the front-to-rear direction (X-direction), respectively. Each of the first side wall 202 and the second side wall 204 extends along the positive Z-direction (upper direction).

As can be seen from FIG. 3, a lower end of the caulking-cover portion 240 is located below the front side of the contact 200 in an upper-to-lower direction (Z-direction) perpendicular to both the front-to-rear direction (X-direction) and the width direction (Y-direction). In other words, the front end 200*f* of the contact 200 is arranged to be slightly upper than the rear end 200*r* of the contact 200.

As shown in FIGS. 1 and 2, the first side wall 202 is formed with a plate portion (first directional control portion) 220 and a rear plate portion (second directional control portion) 230. The plate portion 220 according to the present embodiment is formed on a front end of the first side wall 202 so as to extend in a plane perpendicular to the Y-direction (width direction). In detail, the plate portion 220 extends rearward (i.e. extends in a direction crossing the width direction) from the front end of the first side wall 202 (i.e. the front end 200*f* of the contact 200) in the X-direction (front-to-rear direction). The plate portion 220 also extends upward from the bottom plate 206 in the Z-direction (upper-to-lower direction).

As shown in FIGS. 1 to 4, the plate portion 220 has a front edge 220*f*, a rear edge 220*r* and an upper edge 220*t*. The front edge 220*f* and the rear edge 220*r* are formed on opposite ends of the plate portion 220 in the X-direction, respectively. The front edge 220*f* is formed in a planar shape perpendicular to the X-direction so as to extend upward from the bottom plate 206. The upper edge 220*t* is formed in a planar shape perpendicular to the Z-direction so as to extend rearward from an upper end of the front edge 220*f*. The rear edge 220*r* extends downward from a rear end of the upper edge 220*t*. In detail, the rear edge 220*r* has a second engaged portion 222 and a curved portion 224. The second engaged portion 222 of the rear edge 220*r* extends downward in a plane perpendicular to the X-direction from the rear end of the upper edge 220*t* so that the second engaged portion 222 is formed in a rectangular shape extending long in the Z-direction. The curved portion 224 further extends downward from a lower end of the second engaged portion 222 while curving.

The plate portion 220 has a main surface 226 and a main surface (second abutment portion) 228 formed on opposite sides thereof in the Y-direction, respectively. The main surface 228 according to the present embodiment is formed inward in the Y-direction (width direction) of the plate portion 220 (i.e. located at the negative Y-side of the plate portion 220). The main surface 228 is formed in a planar shape perpendicular to the Y-direction. The plate portion 220 is formed with an engaging hole 229 having a rectangular shape. The engaging hole 229 extends in the positive Y-direction from the main surface 228 to the main surface 226 so as to pierce the plate portion 220 in the Y-direction.

The rear plate portion 230 is formed rearward of the plate portion 220 so as to be apart from the plate portion 220 in the X-direction. Similar to the plate portion 220, the rear plate portion 230 is formed in a tabular shape perpendicular to the Y-direction. The plate portion 220 and the rear plate portion 230 protrude upward as compared with the other parts of the first side wall 202. The upper end (upper edge 220*t*) of the plate portion 220 and an upper end of the rear plate portion 230 are substantially located at a same position in the Z-direction.

Figure 3:
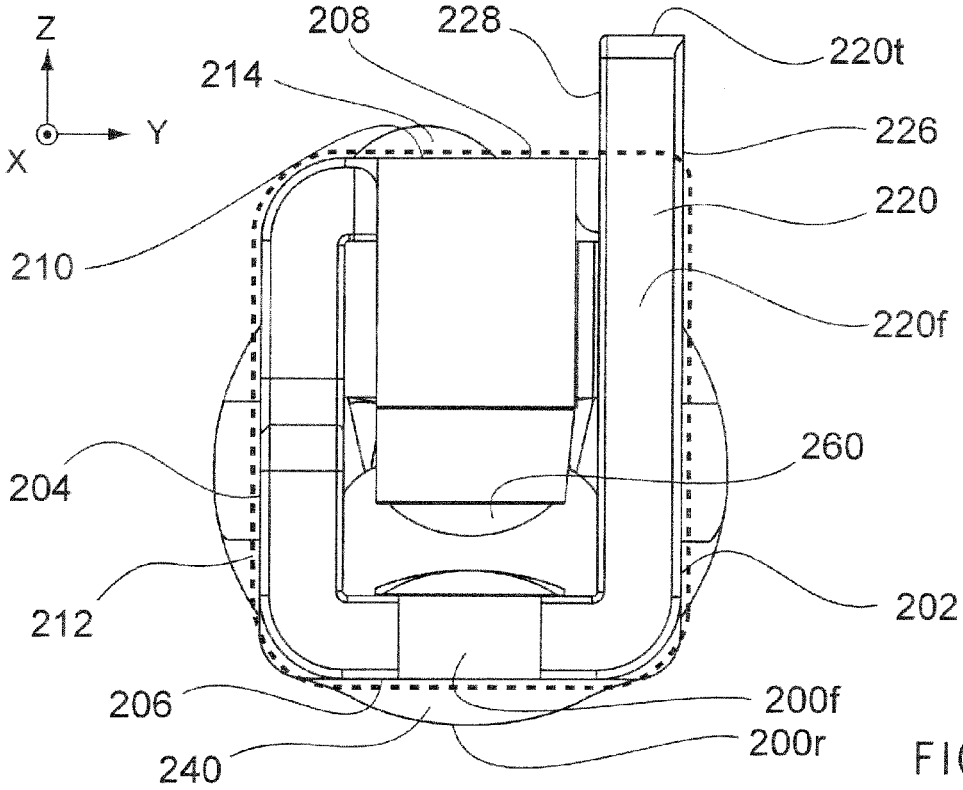
FIG. 3 is a front view showing the connector of FIG. 1.
Figure 4:
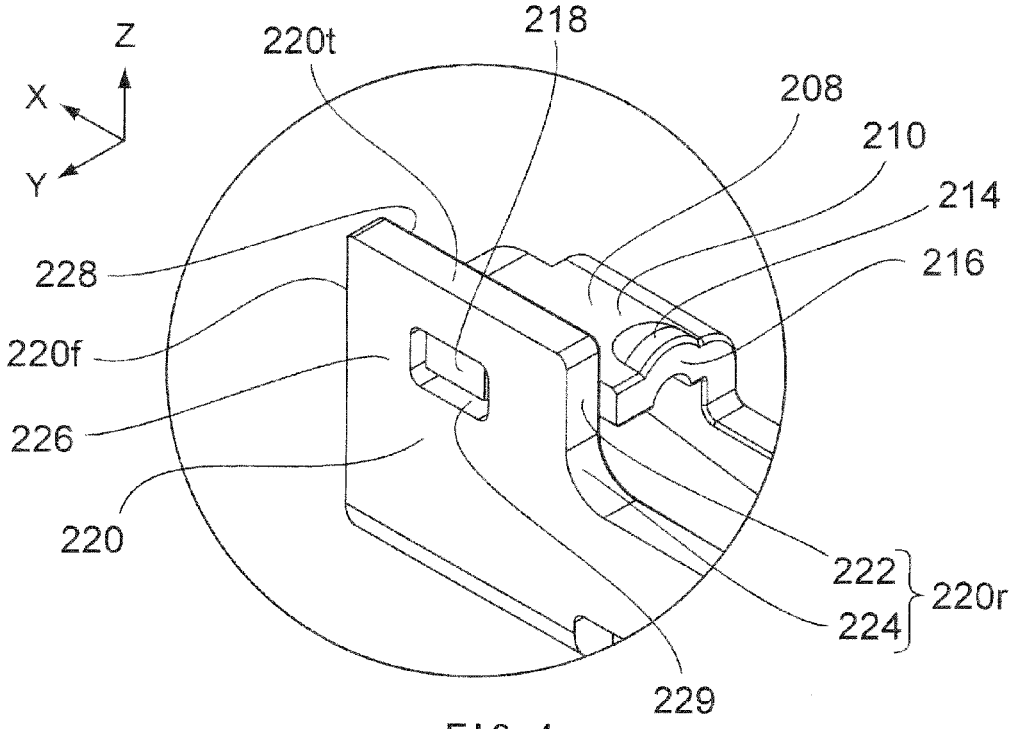
FIG. 4 is a partially enlarged, perspective view showing about a plate portion (i.e. a region indicated by the dashed line A) of the connector of FIG. 1.

As shown in FIGS. 2 to 4, the second side wall 204 partially protrudes upward at a position a little back from the front end 200*f*. The upward protruding part of the second side wall 204 is bent to extend toward the first side wall 202 so that the upward protruding part is formed with an upper plate 208. The upper plate 208 extends so as to be close to the first side wall 202 in the Y-direction. The upper plate 208 has an engaging projection 218 formed on the positive Y-side end thereof. The engaging projection 218 is formed in a shape corresponding to the engaging hole 229. The engaging projection 218 is inserted in the engaging hole 229. The upper plate 208 is kept at a predetermined position by the engagement of the engaging projection 218 with the engaging hole 229. In other words, the upper plate 208 is configured so as not to be easily deformed downward even when the upper plate 208 receives a downward force.

As shown in FIGS. 3 and 4, the contact 200 has a square-tube portion 212 (see a part illustrated by dashed line in FIG. 3) formed about the front end 200*f*. The square-tube portion 212 has a square-tubular shape. In detail, the square-tube portion 212 is a part which is enclosed by a part of the bottom plate 206, the plate portion 220 of the first side wall 202, a part of the second side wall 204 and the upper plate 208. The square-tube portion 212 is configured so that a male contact (not shown), which is a mating contact of the contact 200, is inserted thereinto. The square-tube portion 212 has a rectangular shape as seen along the X-direction (front-to-rear direction) from the front end 200*f*. The upper edge 220*t* of the plate portion 220 is located above the square-tube portion 212. In other words, the plate portion 220 extends so as to be away from the square-tube portion 212.

As shown in FIGS. 2 and 3, a middle part of the upper plate 208 in the Y-direction is bent downward at a front side (i.e. positive X-side) thereof and is further bent so as to extend rearward (i.e. extend along the negative X-direction). The part which is bent to extend rearward (i.e. extending rearward portion) is formed with a contact portion 260 (see FIG. 3). The contact portion 260 is located in the vicinity of the rear end of the extending rearward portion so as to project downward. The contact portion 260 is configured to be brought into contact with the male contact inserted into the square-tube portion 212 so that the contact 200 and the male contact are electrically connected to each other.

As shown in FIGS. 2 to 4, the upper plate 208, which constitutes a part of the square-tube portion 212, has an upper surface (first abutment portion) 210. In other words, the square-tube portion 212 has the upper surface 210. The upper surface 210 is roughly formed in a planar shape perpendicular to the Z-direction. In detail, a rear side of the upper surface 210 protrudes upward about a center thereof in the Y-direction so that the upper surface 210 is formed with a convex portion 214. The convex portion 214 has a convex lens-like shape (see FIG. 3) as seen along the X-direction (front-to-rear direction). The upper plate 208 is formed with a first engaged portion 216 on a rear end thereof. In other words, the first engaged portion 216 according to the present embodiment is provided on the rear end of the upper side of the square-tube portion 212. The first engaged portion 216 is formed in a planar shape perpendicular to the X-direction (front-to-rear direction). The first engaged portion 216 has an arch-like shape as seen along the X-direction. In detail, the first engaged portion 216 has opposite sides in the Y-direction. The first engaged portion 216 further has a middle part located between the opposite sides in the Y-direction. Each of the opposite sides of the first engaged portion 216 is formed in a rectangular shape, and the middle part of the first engaged portion 216 is bent upward.

Figure 7:
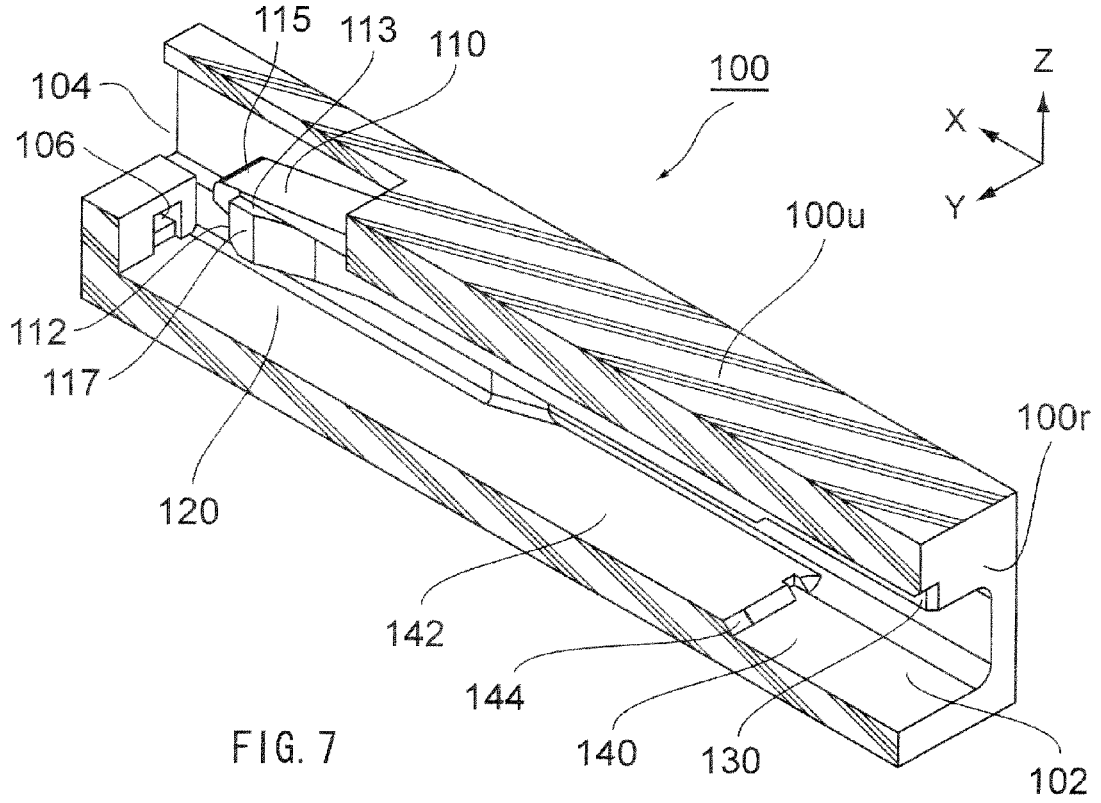
FIG. 7 is a partially cutaway, perspective view showing the housing of FIG. 6 from the rear side of the housing.
Figure 8:
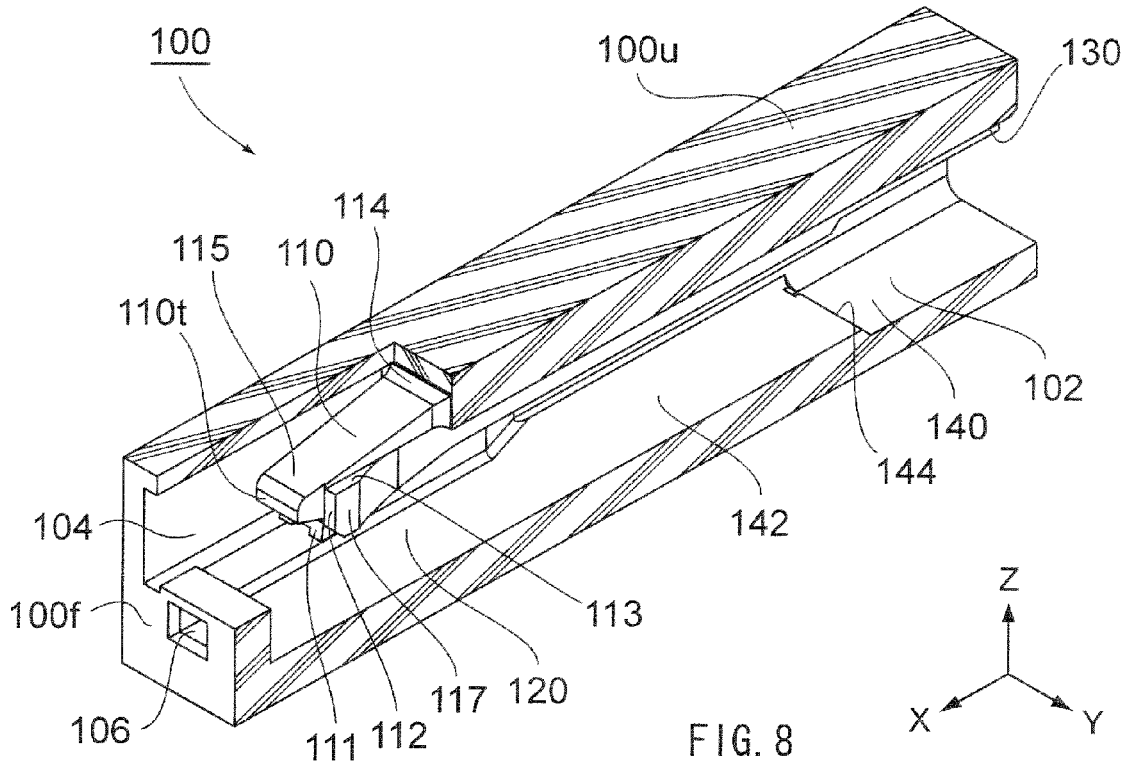
FIG. 8 is a partially cutaway, perspective view showing the housing of FIG. 6 from the front side of the housing downwardly.
Figure 9:
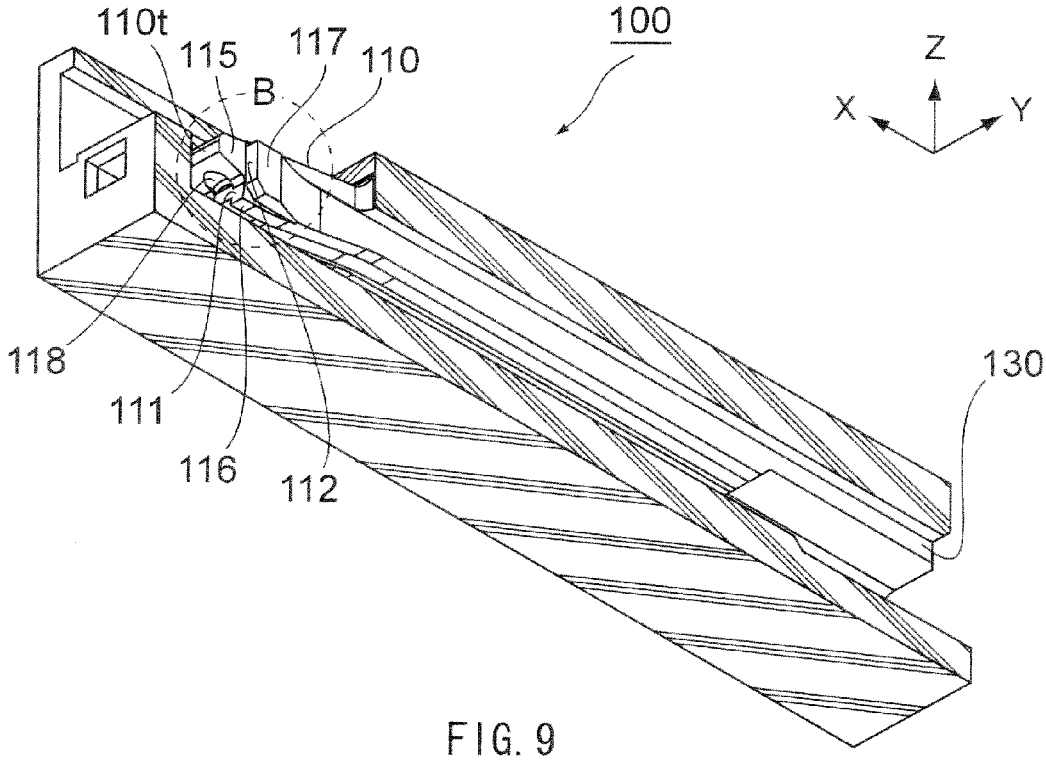
FIG. 9 is a partially cutaway, perspective view showing the housing of FIG. 6 from the front side of the housing upwardly.

As shown in FIGS. 7 to 9, the housing 100 is formed with an accommodating portion 120. The accommodating portion 120 is formed inside the housing 100. In detail, the accommodating portion 120 is formed at a front side of the hole 102 of the housing 100. The accommodating portion 120 is configured to accommodate the front side of the contact 200 when the contact 200 is inserted from the rear end 100*r* of the housing 100 toward the front end 100*f* to be located at an accommodating position (a position shown in FIGS. 11 to 14).

As shown in FIGS. 1 and 7 to 9, the housing 100 is further provided with an upper wall 100*u*. The upper wall 100*u* of the housing 100 is formed with a slit 130. The slit 130 is formed on the hole 102 so as to communicate with the accommodating portion 120. The slit 130 has a rectangular shape as seen along the X-direction from the rear end 100*r* of the housing 100. The position of the slit 130 in the Y-direction (width direction) is off the center of the hole 102 in the Y-direction to the positive Y-side. A width of the slit 130 in the Y-direction corresponds to a width of each of the plate portion 220 and the rear plate portion 230 in the Y-direction. A distance between a lower end of the hole 102 and an upper end of the slit 130 is designed to be a little larger than a height of each of the plate portion 220 and the rear plate portion 230 in the Z-direction. On the other hand, a distance between the lower end of the hole 102 and a lower end of the slit 130 (i.e. upper end of the hole 102) is designed to be smaller than the height of each of the plate portion 220 and the rear plate portion 230 in the Z-direction. Therefore, the contact 200 is able to be inserted into the hole 102 only when the plate portion 220 and the slit 130 are positioned so as to correspond to each other.

As can be seen from the previous description, the slit 130 is configured to allow the plate portion 220 and the rear plate portion 230 to pass therethrough while the contact 200 moves toward the accommodating position. In other words, each of the plate portion 220 and the rear plate portion 230 functions as a directional control portion which makes the contact 200 to be moved in a proper direction and to be accommodated at a proper position (i.e. accommodating position) in the accommodating portion 120.

As shown in FIGS. 7 to 9, the housing 100 has a first bottom 140 and a second bottom 142 formed therewithin. Each of the first bottom 140 and the second bottom 142 has a planar shape perpendicular to the Z-direction. The first bottom 140 is formed at a rear side (i.e. a side where the rear end 100*r* is placed) of the housing 100 while the second bottom 142 is formed at a front side (i.e. a side where the front end 100*f* is placed) of the housing 100. The second bottom 142 is located at a higher position than the first bottom 140 in the Z-direction so that the housing 100 is formed with a step 144 between the first bottom 140 and the second bottom 142. The step 144 extends from a front end of the first bottom 140 to a rear end of the second bottom 142 so as to slope up. A distance between the first bottom 140 and the second bottom 142 in the Z-direction is nearly equal to a distance between a lower end of the front end 200*f* and a lower end of the rear end 100*r* of the contact 200 in the Z-direction (see FIG. 3).

As shown in FIGS. 7 and 8, a rear part of the upper wall 100*u*, which is located rearward of the accommodating portion 120, protrudes downward within the hole 102 as compared with another part of the upper wall 100*u*, which is located over the accommodating portion 120. The housing 100 has a lance 110 formed within the accommodating portion 120. In detail, the lance 110 is formed at a head of the rear part (i.e. the aforementioned protruding portion) of the upper wall 100*u* in the X-direction so as to project in the positive X-direction. The lance 110 is configured to be engaged with the contact 200 inserted in the accommodating portion 120 of the housing 100.

As shown in FIGS. 7 to 10, the lance 110 has a fixed end 114 and a tip 110*t*. The fixed end 114 is fixed to the protruding portion of the upper wall 100*u*. On the other hand, the tip 110*t* is a free end. In other words, the lance 110 is elastically supported by the upper wall 100*u* so that the tip 110*t* of the lance 110 is movable in both the Z-direction (upper-to-lower direction) and the Y-direction (left-to-right direction).

The lance 110 is roughly formed in a tabular shape. In detail, the lance 110 extends forward so as to slope down. The lance 110 is provided with a side protrusion 113 and a projection 115. The side protrusion 113 is provided at a middle part of the lance 110 in the X-direction (front-to-rear direction). The side protrusion 113 protrudes in the positive Y-direction from the positive Y-side of the lance 110. The projection 115 is located forward of a front end of the side protrusion 113 in the X-direction (front-to-rear direction). In other words, the projection 115 is a front end of the lance 110 in the X-direction (front-to-rear direction). The projection 115 extends forward to the tip 110*t* while reducing its thickness in the Z-direction.

As shown in FIGS. 5, 6, 9 and 10, the lance 110 is provided with a first engaging portion 111. The first engaging portion 111 is provided on a lower side of the lance 110 in the Z-direction (upper-to-lower direction). The first engaging portion 111 according to the present embodiment is formed below the projection 115 in the Z-direction (upper-to-lower direction) so as to extend in the Y-direction (width direction). The first engaging portion 111 is formed in a planar shape perpendicular to the X-direction (front-to-rear direction) so that the first engaging portion 111 corresponds to the first engaged portion 216. In detail, the first engaging portion 111 has opposite sides in the Y-direction. The first engaging portion 111 further has a middle part located between the opposite sides in the Y-direction. Each of the opposite sides of the first engaging portion 111 is formed in a rectangular shape. The middle part of the first engaging portion 111 has a depressed lower side portion and an arch-like shaped upper side portion which protrudes upward. As can be seen from the above description, the first engaging portion 111 is configured to be engaged with the first engaged portion 216 of the contact 200 located at the accommodating position.

Figure 5:
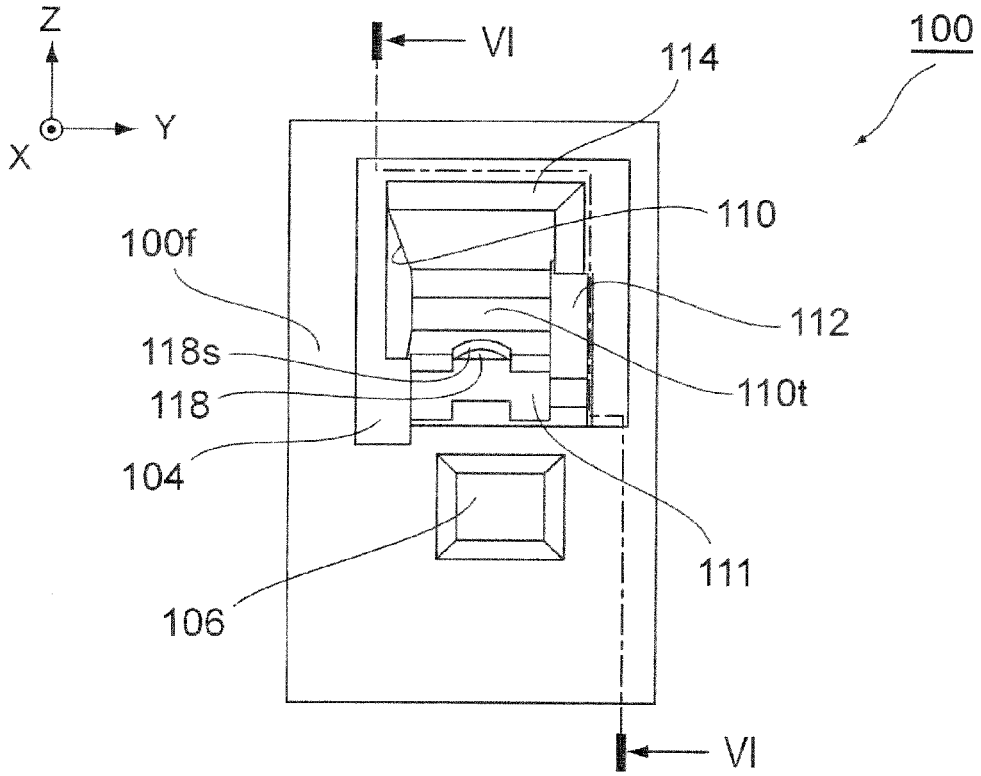
FIG. 5 is a front view showing the housing of FIG. 1, wherein an upper part of lines VI-VI extends along the negative Y-side wall of the housing in a front side of the housing (i.e. in an accommodating portion of the housing) while extending along the positive Y-side wall of the housing in a rear side of the housing.
Figure 6:
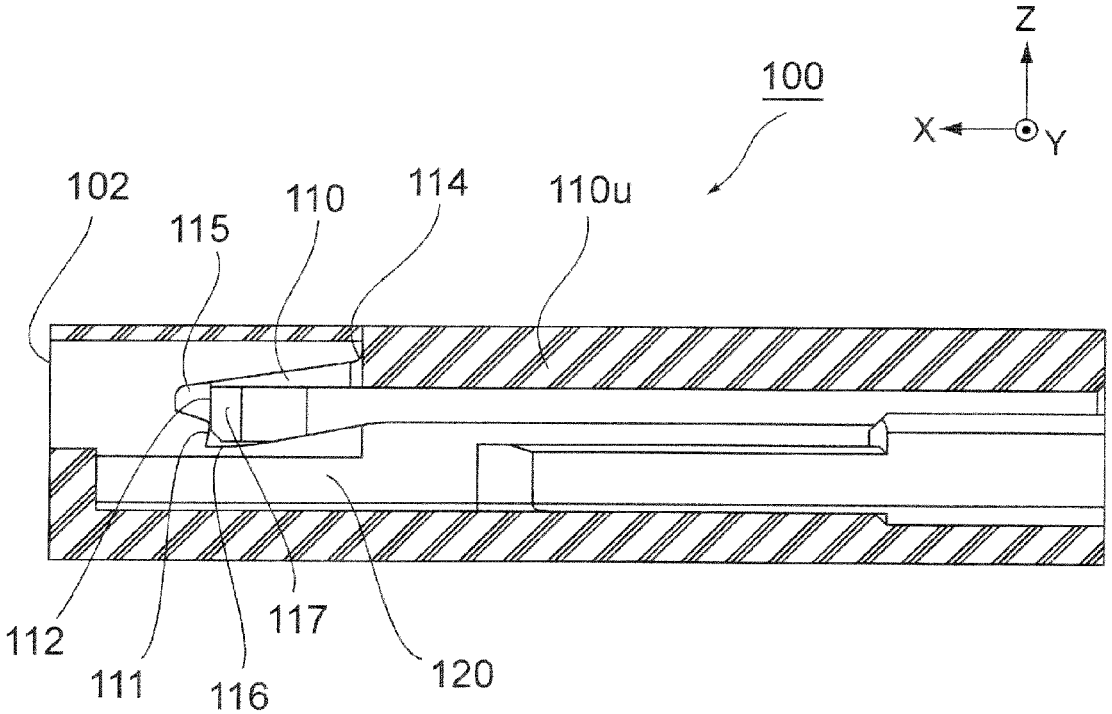
FIG. 6 is a cross-sectional view showing the housing of FIG. 5, taken along lines VI-VI.
Figure 10:
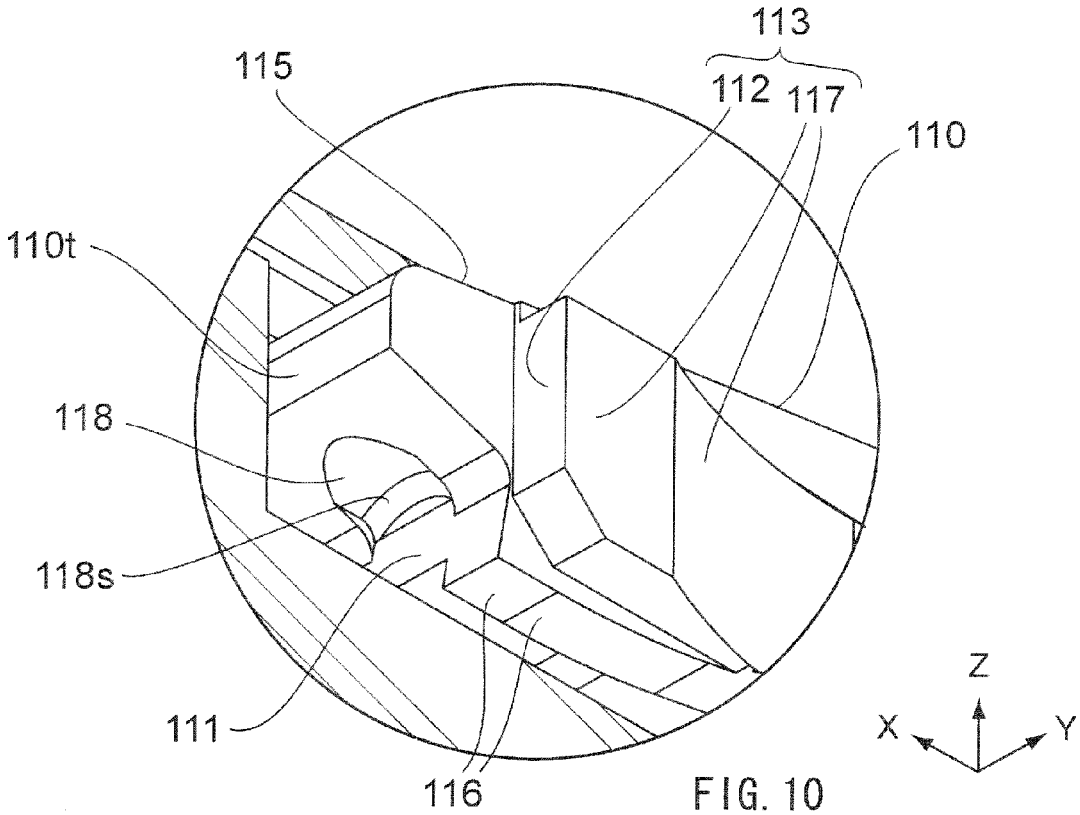
FIG. 10 is a partially enlarged, perspective view showing about a tip of a lance (i.e. a region indicated by the dashed line B) of the housing of FIG. 9.

As shown in FIGS. 5, 9 and 10, the projection 115 has a depression 118. The depression 118 is formed on a lower side of the projection 115 in the Z-direction (upper-to-lower direction) so as to be depressed upwardly. The depression 118 is formed at a position which corresponds to the arch-like shaped upper side portion of the first engaging portion 111 in the Z-direction (see FIG. 10). The depression 118 has a concave surface 118*s*. The concave surface 118*s* is a part of a lower surface of the projection 115. The concave surface 118*s* is formed in an arch-like shape which is curved obliquely upwardly. In other words, the most part of the concave surface 118*s* crosses both the X-direction and the Y-direction.

As shown in FIGS. 5 to 10, the side protrusion 113 of the lance 110 is provided with a second engaging portion 112. The second engaging portion 112 according to the present embodiment is formed on the front end of the side protrusion 113. In other words, the second engaging portion 112 is formed on a side of the projection 115 (i.e. formed on a side of the lance 110) in the Y-direction (width direction). The second engaging portion 112 extends in a direction crossing the Y-direction (width direction). Especially, the second engaging portion 112 according to the present embodiment extends in the Z-direction (upper-to-lower direction). The second engaging portion 112 is configured to be engaged with the second engaged portion 222 of the contact 200 located at the accommodating position. The second engaging portion 112 is formed in a shape corresponding to the second engaged portion 222. More specifically, the second engaging portion 112 is formed in a planar shape perpendicular to the X-direction (front-to-rear direction) so as to have a rectangular shape extending long in the Z-direction. A distance between the second engaging portion 112 and the fixed end 114 of the lance 110 in the Z-direction (upper-to-lower direction) is shorter than a distance between the first engaging portion 111 and the fixed end 114 in the Z-direction (upper-to-lower direction).

As shown in FIGS. 6 to 10, the lance 110 further has a first pressed portion 116 and a second pressed portion 117. The first pressed portion 116 is provided on a lower surface of the lance 110. The first pressed portion 116 is located rearward of the first engaging portion 111 in the X-direction (front-to-rear direction). The first pressed portion 116 has a planar part and a sloping part (or a beveled part). In detail, the planar part of the first pressed portion 116 extends rearward (i.e. along the negative X-direction) in a plane perpendicular to the Z-direction from a lower end of the first engaging portion 111. The sloping part of the first pressed portion 116 further extends rearward (i.e. along the negative X-direction) from a rear end of the planar part while sloping up (i.e. extending in the positive Z-direction). The lower surface of the lance 110 is further formed with a recessed channel. The recessed channel is formed at the negative Y-side of the first pressed portion 116. The recessed channel is recessed upward so as to correspond to a shape of the first engaging portion 111 (see FIG. 10). The second pressed portion 117 is formed as a side surface of the side protrusion 113. The second pressed portion 117 is located rearward of the second engaging portion 112 in the X-direction (front-to-rear direction). The second pressed portion 117 has a planar part and a sloping part. In detail, according to the present embodiment, the planar part of the second pressed portion 117 extends rearward (i.e. along negative X-direction) in a plane perpendicular to the Y-direction from the front end of the side protrusion 113. The sloping part of the second pressed portion 117 further extends rearward (i.e. along negative X-direction) from a rear end of the planar part while inclining in the negative Y-direction. As described above, each of the first pressed portion 116 and the second pressed portion 117 according to the present embodiment has the planar part. However, each of the first pressed portion 116 and the second pressed portion 117 may not have the planar part.

As shown in FIGS. 5, 7 and 8, the front end 100*f* of the housing 100 is formed with an opening 104 and an insert hole 106. Each of the opening 104 and the insert hole 106 communicates with the accommodating portion 120. The opening 104 is formed at a position corresponding to the lance 110 in the Y-direction and the Z-direction. The insert hole 106 is formed at a position corresponding to the contact portion 260 of the contact 200 in the Y-direction and the Z-direction under a state where the contact 200 is inserted in the housing 100 to be located at the accommodating position.

As can be seen from FIG. 1, when the contact 200 is inserted into the housing 100 which is configured as described above, the front end 200*f* of the contact 200 is inserted into the hole 102 of the housing 100 in a state where the plate portion (first directional control portion) 220 of the contact 200 and the slit 130 of the housing 100 are positioned each other.

Figure 15A:
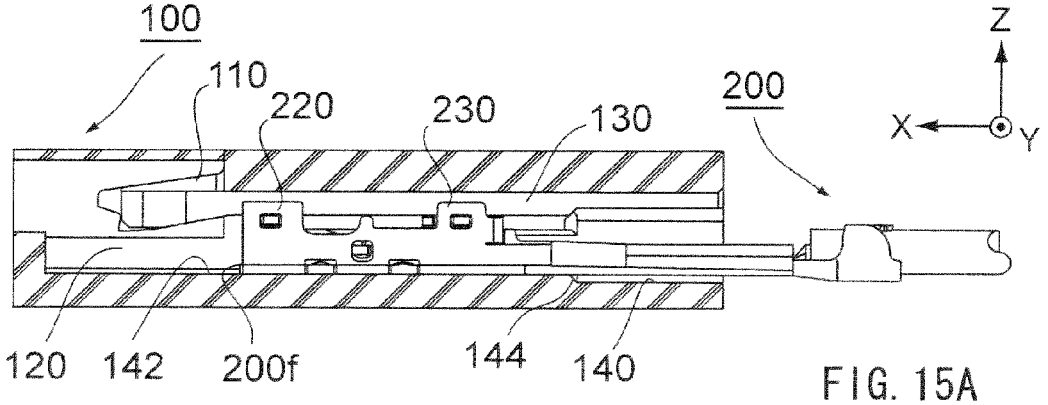
FIG. 15A and FIG. 15B are cross-sectional views each showing a process where the contact is inserted into the housing of FIG. 12.

As can be seen from FIG. 15A, when the contact 200 inserted in the housing 100 is moved toward the front end 100*f* of the housing 100, the plate portion 220 which is inserted in the hole 102 is guided by the slit 130 so that the contact 200 slides on the first bottom 140 toward the accommodating portion 120. When the contact 200 is kept to be moved toward the front end 100*f*, the front end 200*f* of the contact 200 slides up the step 144 so that the contact 200 slides on the second bottom 142.

Figure 15B:
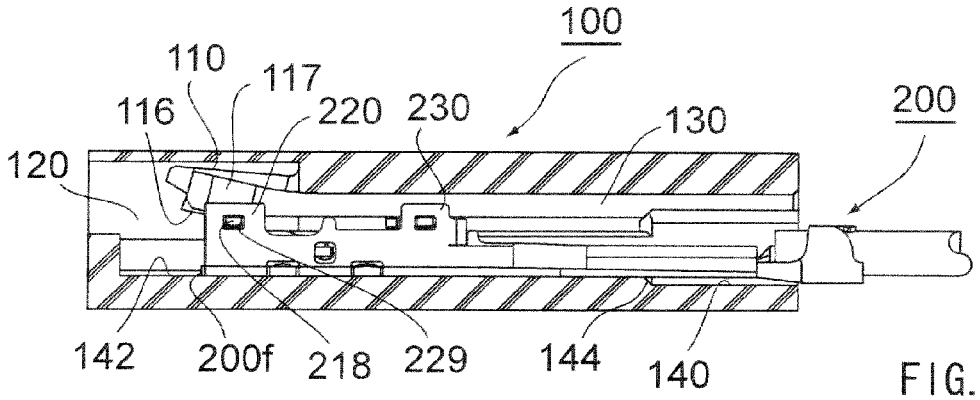
Figure 16:
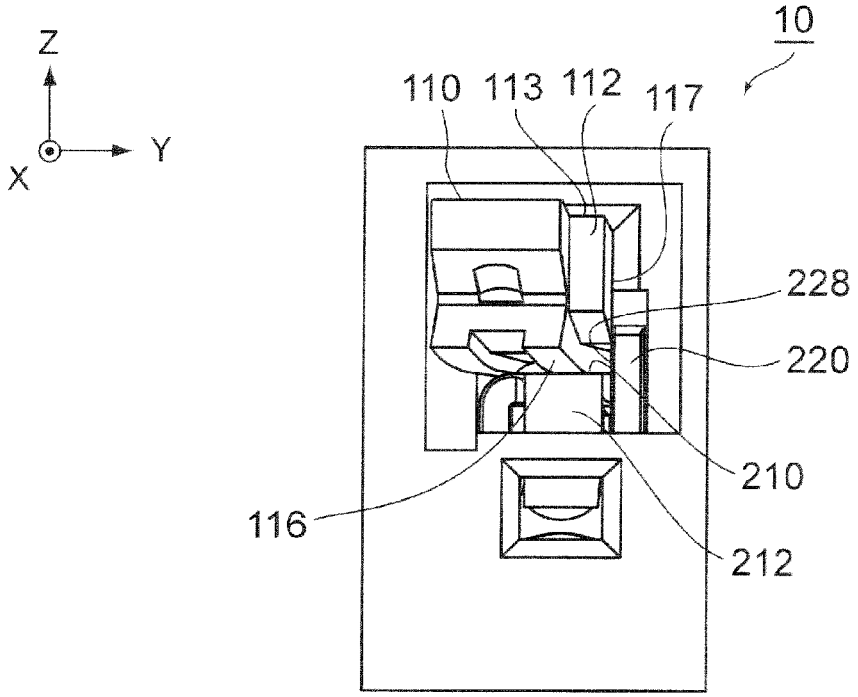
FIG. 16 is a front view showing the connector of FIG. 15B.

As shown in FIGS. 15B and 16, when the contact 200 is further kept to be moved, the front end 200*f* of the contact 200 is accommodated within the accommodating portion 120. Meanwhile, the upper surface 210 of the square-tube portion 212 functions as the first abutment portion 210, and the main surface 228 which is located inward in the Y-direction (width direction) of the plate portion 220 functions as the second abutment portion 228. More specifically, while the contact 200 moves toward the accommodating position, the upper surface 210 is brought into abutment with the first pressed portion 116 in the Z-direction (upper-to-lower direction) and the main surface 228 is brought into abutment with the second pressed portion 117 in the Y-direction (width direction). According to the present embodiment, at the substantially same time as the upper surface (first abutment portion) 210 is brought into abutment with the first pressed portion 116, the main surface (second abutment portion) 228 is brought into abutment with the second pressed portion 117. As described previously, the engagement of the engaging projection 218 with the engaging hole 229 prevents the first abutment portion 210 from being deformed in the negative Z-direction (i.e. being moved downward). Moreover, the engagement of the rear plate portion 230 with the slit 130 regulates the movement of the second abutment portion 228 in the positive Y-direction (i.e. the outward movement of the second abutment portion 228). Therefore, the first pressed portion 116 is pressed to be moved by the first abutment portion 210 in the positive Z-direction. The second pressed portion 117 is pressed to be moved by the second abutment portion 228 in the negative Y-direction. In other words, while the contact 200 moves toward the accommodating position, the first abutment portion 210 presses up the first pressed portion 116 (i.e. presses up the lance 110) in the Z-direction (upper-to-lower direction), and the second abutment portion 228 presses the second pressed portion 117 (i.e. presses the lance 110) toward the negative Y-side in the Y-direction (width direction). Thus, while the contact 200 moves toward the accommodating position, the first abutment portion 210 and the second abutment portion 228 are brought into abutment with the first pressed portion 116 and the second pressed portion 117 to press them, respectively, so that the lance 110 is elastically deformed along a direction oblique to both the Y-direction (width direction) and the Z-direction (upper-to-lower direction).

Figure 17:
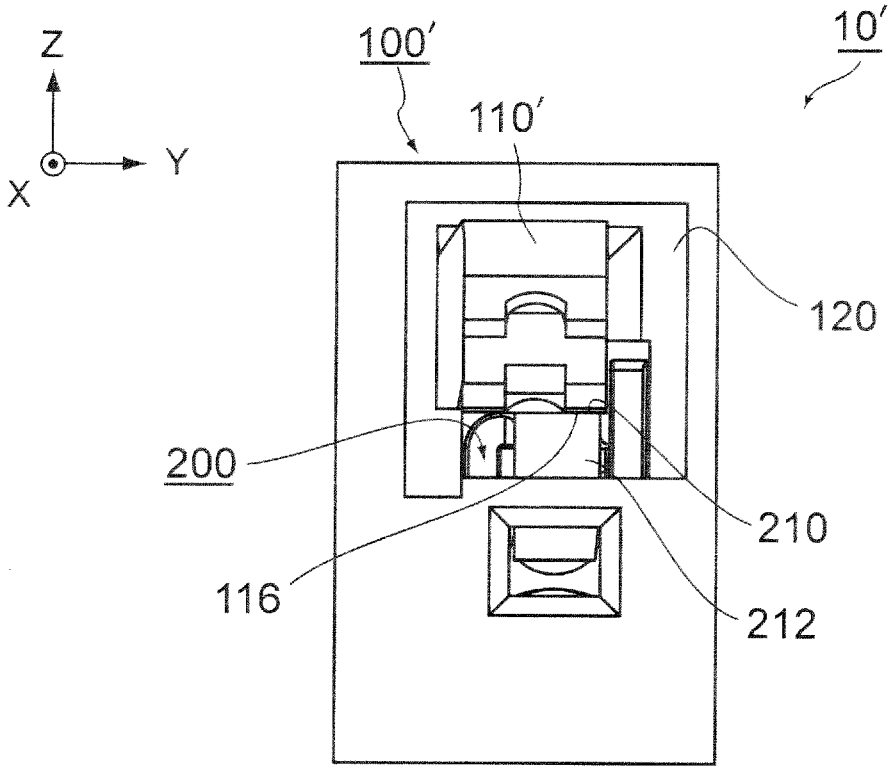
FIG. 17 is a front view showing an existing connector which comprises a housing without a second pressed portion, wherein the existing connector is in a state similar to the connector of FIG. 15B.
Figure 18:
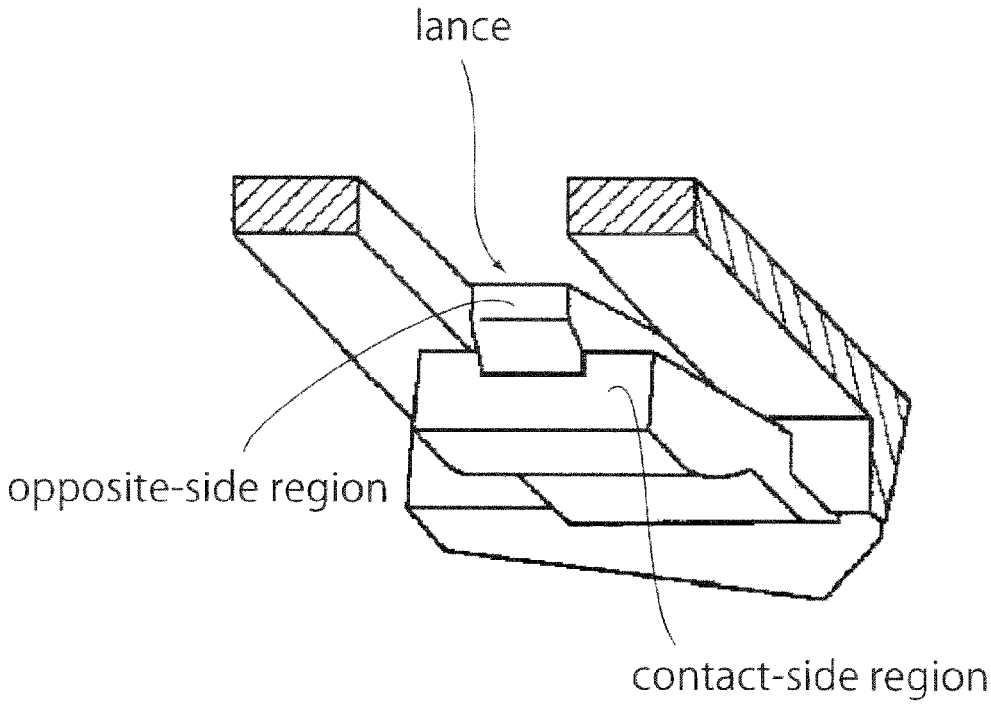
FIG. 18 is a perspective view showing an existing lance.
Figure 19:
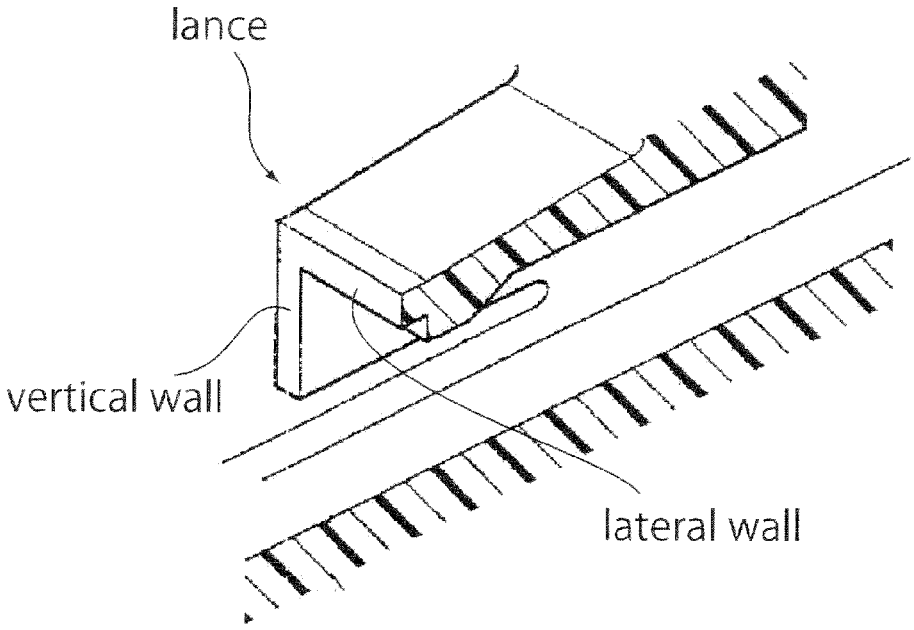
FIG. 19 is a perspective view showing another existing lance.

As shown in FIG. 17, an existing connector 10' is configured similar to but a little different from the connector 10. More specifically, the connector 10' comprises a housing 100' formed with a lance 110'. The lance 110' is provided with the first pressed portion 116. However, the lance 110' is not provided with the second pressed portion 117. Therefore, while the contact 200 is moved to be accommodated in the accommodating portion 120 of the housing 100', the first abutment portion 210 is brought into abutment with the first pressed portion 116 so that the lance 110' is elastically deformed only upward. On the other hand, the connector 10 according to the present embodiment is provided with the second pressed portion 117 so that the lance 110 is elastically deformed obliquely upward. In other words, the lance 110 according to the present embodiment is deformed by a resultant force of two forces. One of the two forces is a force along the positive Z-direction applied from the first abutment portion 210. The other one of the two forces is a force along the negative Y-direction applied from the second abutment portion 228. As can be seen from the above description, the lance 110 according to the present embodiment is more easily deformed than the lance 110' of the existing connector 10'. Therefore, according to the present embodiment, the contact 200 is more easily inserted into the housing 100.

Figure 11:
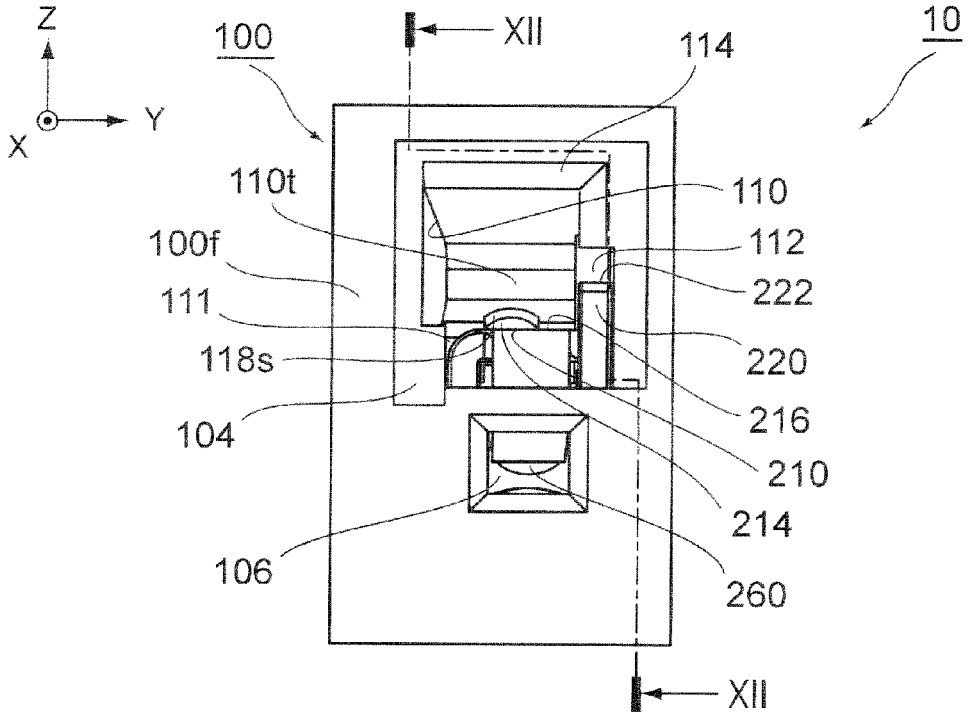
FIG. 11 is a front view showing the connector of FIG. 1 in a state where the contact is inserted in the housing, wherein an upper part of lines XII-XII extends along the negative Y-side wall of the housing in the front side of the housing (i.e. in the accommodating portion of the housing) while extending along the positive Y-side wall of the housing in the rear side of the housing.
Figure 12:
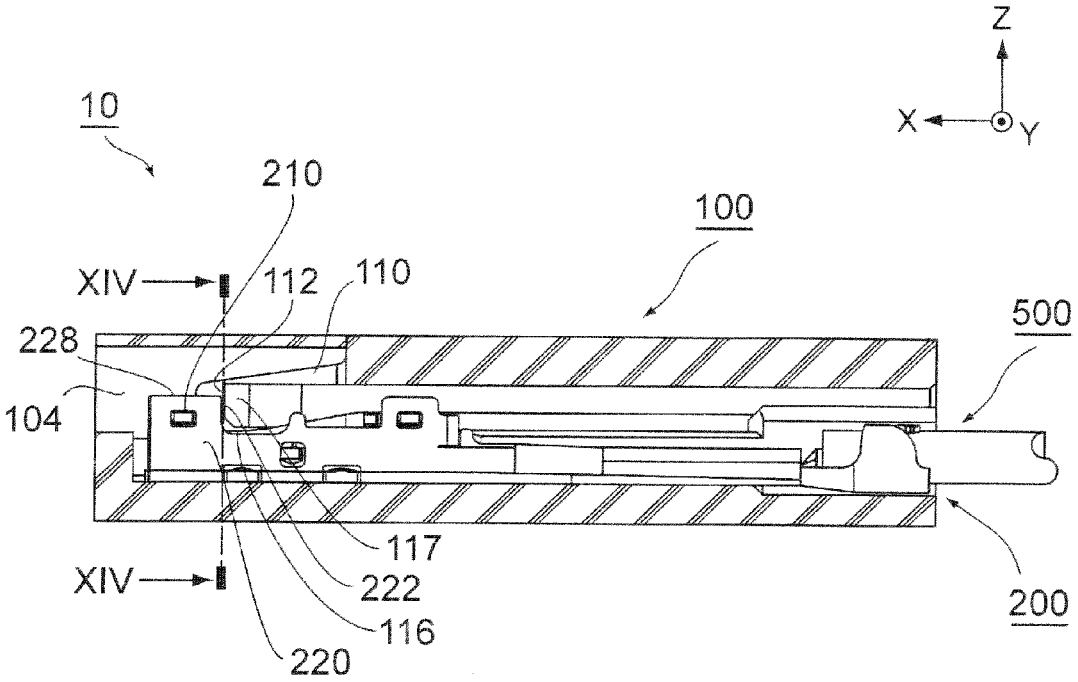
FIG. 12 is a cross-sectional view showing the connector of FIG. 11, taken along lines XII-XII.
Figure 13:
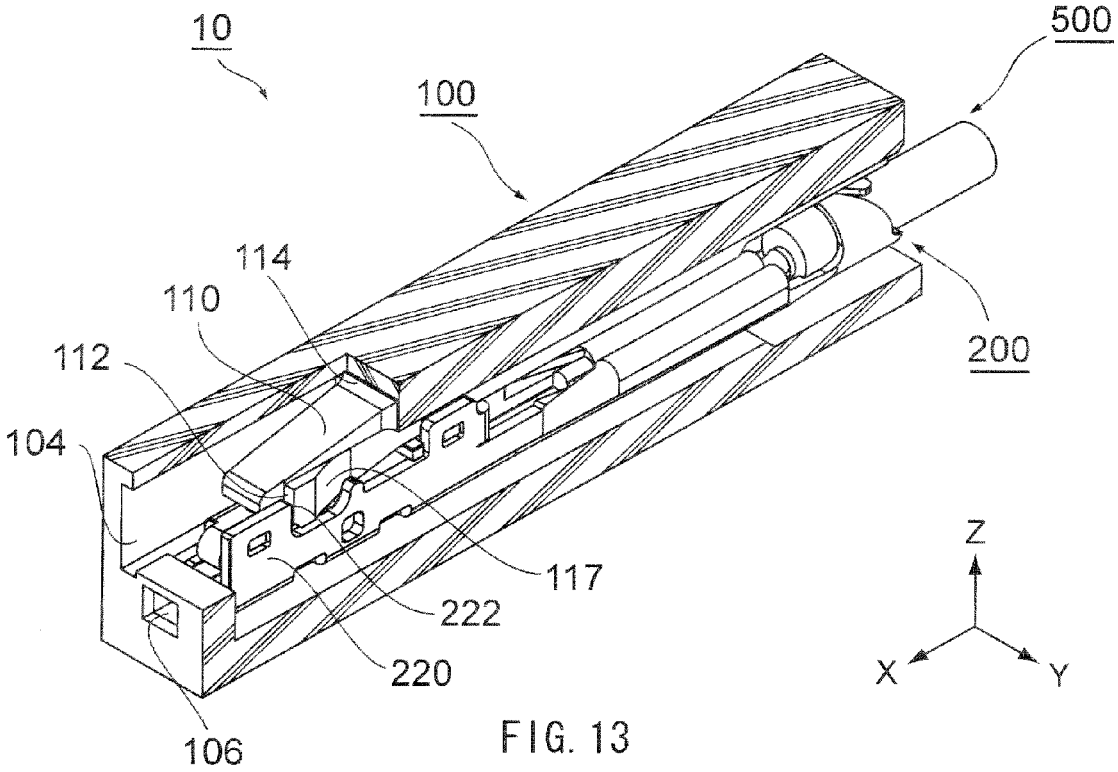
FIG. 13 is a partially cutaway, perspective view showing the connector of FIG. 12.
Figure 14:
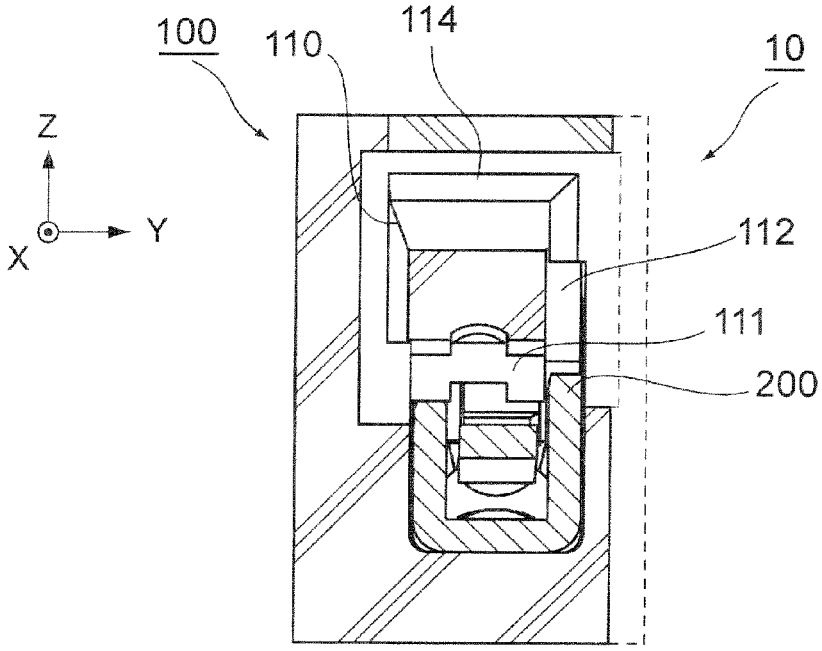
FIG. 14 is a cross-sectional view showing the connector of FIG. 12, taken along lines XIV-XIV, wherein dashed lines show a part of the positive Y-side wall of the housing which is cut away by lines XII-XII of FIG. 11.

As shown in FIGS. 11 to 13, when the contact 200 which is located at a position shown in FIG. 15B is further moved into the accommodating portion 120, the contact 200 arrives at the accommodating position (insertion-completed position) where the contact 200 is connectable to the mating contact (not shown). When the contact 200 arrives at the accommodating position, the first abutment portion 210 and the second abutment portion 228 are located forward of the first pressed portion 116 and the second pressed portion 117, respectively. Therefore, when the contact 200 arrives at the accommodating position, each of the first pressed portion 116 and the second pressed portion 117 returns to its original position where it is located before the lance 110 is elastically deformed.

When the contact 200 is located at the accommodating position, the contact portion 260 of the contact 200 is able to be brought into contact with an end of the mating contact (not shown) which is inserted in the accommodating portion 120 through the insert hole 106. The mating contact and the cable 500 are electrically connected with each other through the contact 200 because of the contact of the contact 200 with the mating contact.

As shown in FIGS. 11 to 14, when the contact 200 is located at the accommodating position, the two engaging portions of the lance 110 (i.e. the first engaging portion 111 and the second engaging portion 112) which are different from each other are engaged, in the X-direction (front-to-rear direction), with the two engaged portions provided on the contact 200 (i.e. the first engaged portion 216 and the second engaged portion 222) which are distinguished from each other, respectively. The connector 10 according to the present embodiment has the two engaging portions so that it is possible to enlarge the engaged area. Therefore, it is possible to hold the contact 200 securely while keeping the strength of the lance 110 and avoiding that the contact 200 is not easily inserted into the housing 100.

According to the present embodiment, while the first engaging portion 111 is provided on the lower side of the lance 110, the second engaging portion 112 is provided on the side of the lance 110 in the width direction. In other words, the second engaging portion 112 is located nearer to the fixed end 114 of the lance 110 in the Z-direction as compared with the first engaging portion 111 so that the center of the two engaging portions gets close to the fixed end 114. Therefore, the lance 110 is not easily deformed downward when the contact 200 is forced to be pulled out. In detail, when a force along the negative X-direction is applied to the contact 200, the most part of the force is received by the fixed end 114 so that the engaging strength of the lance 110 is able to be improved (i.e. the housing 100 is able to hold the contact 200 more securely).

Moreover, the first engaged portion 216 faces a plane of the first engaging portion 111 which extends in the Y-direction (width direction). The second engaged portion 222 faces a plane of the second engaging portion 112 which extends in the Z-direction (upper-to-lower direction). As can be seen from the above description, the contact 200 is engaged with both the laterally long part and the vertically long part of the lance 110 so that the engaging strength of the lance 110 is able to be more improved.

According to the present embodiment, the second engaged portion 222 is a part of the plate portion 220 which is necessary as a directional control portion. Therefore, the housing 100 may not become large even if the housing 100 is provided with the second engaging portion 112 which is configured to be engaged with the second engaged portion 222. The housing 100 has a space (gap) where a part of the lance 110 is placed when the lance 110 is deformed in the negative Y-direction. This gap of the housing 100 is a trace which is formed when the housing 100 is molded. As can be seen from the above description, the housing 100 has the gap even if the lance 110 is not configured to be deformed in the negative Y-direction. Therefore, according to the present embodiment, without enlarging the housing 100, it is possible to form the second engaging portion 112 on the lance 110 so that it is possible to increase the area of the engaged portion which is engaged with the contact 200. In other words, the second engaging portion 112 according to the present embodiment is provided on the lance 110 so that the engaging strength of the lance 110 is able to be improved without enlarging the housing 100. Moreover, even when the housing 100 has a reduced size (for example, when the lance 110 has a smaller width), the engaging strength of the lance 110 may be kept as compared with a case where the housing 100 is not provided with the second engaging portion 112.

As can be seen from FIGS. 11 and 13, the engagement of the lance 110 with the contact 200 is able to be released, for example, by using a tool having a thin tip (not shown). In detail, the tip of the tool is inserted into the accommodating portion 120 from the opening 104 of the housing 100. The tip of the tool pries the concave surface 118*s* to move the lance 110 upward or obliquely upward so that the engagement is able to be released.

The second engaging portion according to the present embodiment extends in the upper-to-lower direction. However, the second engaging portion may extend in the upper-to-lower direction while inclining, for example, in the front-to-rear direction. In other words, the second engaging portion may extend in a direction crossing the width direction. However, it is necessary that the second engaged portion extends in a direction corresponding to the direction in which the second engaging portion extends. It is preferable that the second engaging portion extends in the upper-to-lower direction similar to the present embodiment so as to improve the engaging strength of the lance.

The plate portion according to the present embodiment extends upward in the upper-to-lower direction. However, the plate portion may extend, for example, obliquely upward. In other words, the plate portion may extend in a direction crossing the width direction. In this case, the main surface formed inward in the width direction of the plate portion is brought into abutment with the second pressed portion to press the lance in a direction crossing the upper-to-lower direction while the contact moves toward the accommodating position.

Although the plate portion according to the present embodiment extends rearward from the front end of the contact, the plate portion may extend rearward from a position spaced rearwardly apart from the front end of the contact. However, considering the position of the lance in the accommodating portion or minimization of the housing, it is preferable that the plate portion extends from the front end of the contact similar to the present embodiment.

Although the contact according to the present embodiment is a female contact provided with the square-tube portion, this invention is also applicable to a male contact.

The present application is based on a Japanese patent application of JP2011-101003 filed before the Japan Patent Office on Apr. 28, 2011, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising:

a contact including a first engaged portion and a second engaged portion, the first engaged portion and the second engaged portion being distinguished from each other; and a housing configured to hold the contact, the housing having a front end and a rear end in a front-to-rear direction, the housing being formed with an accommodating portion, the accommodating portion being configured to accommodate the contact when the contact is inserted from the rear end toward the front end to be located at an accommodating position, the housing having a lance formed within the accommodating portion, the lance being provided with a first engaging portion and a second engaging portion, and the first engaging portion and the second engaging portion being configured to be engaged with the first engaged portion and the second engaged portion of the contact located at the accommodating position, respectively, wherein:

the lance has a first pressed portion and a second pressed portion, the first pressed portion being located rearward of the first engaging portion in the front-to-rear direction, and the second pressed portion being located rearward of the second engaging portion in the front-to-rear direction;

the contact has a first abutment portion and a second abutment portion, the first abutment portion presses up the lance in an upper-to-lower direction perpendicular to the front-to-rear direction while the contact moves toward the accommodating position, and the second abutment portion presses the lance in a width direction perpendicular to both the front-to-rear direction and the upper-to-lower direction while the contact moves toward the accommodating position; and the lance is elastically deformed along a direction oblique to both the width direction and the upper-to-lower direction while the contact moves toward the accommodating position.

2. A connector comprising:

a contact including a first engaged portion and a second engaged portion, the first engaged portion and the second engaged portion being distinguished from each other; and a housing configured to hold the contact, the housing having a front end and a rear end in a front-to-rear direction, the housing being formed with an accommodating portion, the accommodating portion being configured to accommodate the contact when the contact is inserted from the rear end toward the front end to be located at an accommodating position, the housing having a lance formed within the accommodating portion, the lance being provided with a first engaging portion and a second engaging, portion, and the first engaging portion and the second engaging portion being configured to be engaged with the first engaged portion and the second engaged portion of the contact located at the accommodating position, respectively;

wherein:

the lance is provided with a projection at a front end of the lance in the front-to-rear direction;

the first engaging portion is formed below the projection in an upper-to-lower direction perpendicular to the front-to-rear direction;

the second engaging portion is formed on a side of the projection in a width direction perpendicular to both the front-to-rear direction and the upper-to-lower direction; and the projection has a depression formed on a lower side thereof in the upper-to-lower direction, the depression being depressed upwardly.

3. A connector comprising:

a contact including a first engaged portion and a second engaged portion, the first engaged portion and the second engaged portion being distinguished from each other; and a housing configured to hold the contact, the housing having a front end and a rear end in a front-to-rear direction, the housing being formed with an accommodating portion, the accommodating portion being configured to accommodate the contact when the contact is inserted from the rear end toward the front end to be located at an accommodating position, the housing having a lance formed within the accommodating portion, the lance being provided with a first engaging portion and a second engaging, portion, and the first engaging portion and the second engaging portion being configured to be engaged with the first engaged portion and the second engaged portion of the contact located at the accommodating position, respectively, wherein:

the first engaging portion is provided on a lower side of the lance in an upper-to-lower direction perpendicular to the front-to-rear direction;

the second engaging portion is provided on a side of the lance in a width direction perpendicular to both the front-to-rear direction and the upper-to-lower direction; and the lance has a fixed end, and a distance between the second engaging portion and the fixed end in the upper-to-lower direction is shorter than a distance between the first engaging portion and the fixed end in the upper-to-lower direction.

4. The connector as recited in claim 3, wherein:

the contact has a plate portion extending in a direction crossing the width direction; and the second engaged portion is provided on a rear edge of the plate portion.

5. The connector as recited in claim 4, wherein:

the first engaging portion extends in the width direction; and the second engaging portion extends in a direction crossing the width direction.

6. The connector as recited in claim 5, wherein:

the plate portion extends upward in the upper-to-lower direction; and the second engaging portion extends in the upper-to-lower direction.

7. The connector as recited in claim 4, wherein:

the contact is a female contact provided with a square-tube portion, the square-tube portion being configured so that a male contact is insertable thereinto:

the plate portion extends so as to be away from the square-tube portion; and the first engaged portion is provided on a rear end of an upper side of the square-tube portion.

8. The connector as recited in claim 7, wherein:

the lance has a first pressed portion and a second pressed portion, the first pressed portion being located rearward of the first engaging portion in the front-to-rear direction, and the second pressed portion being located rearward of the second engaging portion in the front-to-rear direction;

the square-tube portion of the contact has an upper surface, the upper surface functioning as a first abutment portion, and the first abutment portion presses up the lance in the upper-to-lower direction while the contact moves toward the accommodating position;

the plate portion of the contact has a main surface formed inward in the width direction thereof, the main surface functioning as a second abutment portion, and the second abutment portion presses the lance in a direction crossing the upper-to-lower direction while the contact moves toward the accommodating position; and the lance is elastically deformed along a direction oblique to both the width direction and the upper-to-lower direction while the contact moves toward the accommodating position.

9. The connector as recited in claim 8, wherein:

while the contact moves toward the accommodating position, the second abutment portion is brought into abutment with the second pressed portion so as to press the lance in the width direction.

10. The connector as recited in claim 4, wherein:

the housing is formed with a slit, the slit allowing the plate portion to pass therethrough while the contact moves toward the accommodating position; and the plate portion functions as a directional control portion which makes the contact to be moved in an intended direction and to be accommodated in the accommodating portion.

11. The connector as recited in claim 10, wherein:

the plate portion extends rearward in the front-to-rear direction from a front end of the contact.

* * * * *